United States Patent [19]

Chen et al.

[11] Patent Number: 4,764,266

[45] Date of Patent: Aug. 16, 1988

[54] INTEGRATED HYDROPROCESSING SCHEME FOR PRODUCTION OF PREMIUM QUALITY DISTILLATES AND LUBRICANTS

[75] Inventors: Nai Y. Chen, Titusville; Rene B. LaPierre, Medford; Randall D. Partridge, Trenton; Stephen S. Wong, Medford, all of N.J.

[73] Assignee: Mobil Oil Corporation, New York, N.Y.

[21] Appl. No.: 19,983

[22] Filed: Feb. 26, 1987

[51] Int. Cl.[4] ..... C10G 65/12; C10G 69/02

[52] U.S. Cl. ..... 208/58; 208/18; 208/59; 208/96; 208/97; 208/111; 208/49; 585/739; 585/737

[58] Field of Search ..... 208/111, 60, 59, 58, 208/18, 49; 585/737, 739

[56] References Cited

U.S. PATENT DOCUMENTS

| | | | |
|---|---|---|---|
| 3,654,133 | 4/1972 | Olson | 208/18 |
| 3,730,876 | 5/1973 | Sequeira | 208/59 |
| 3,781,196 | 12/1973 | Thompson | 208/96 |
| 3,793,190 | 2/1974 | Nastast et al. | 208/18 |
| 3,808,122 | 4/1974 | White et al. | 208/59 |
| 4,176,048 | 11/1979 | Corns et al. | 208/59 |
| 4,347,121 | 8/1982 | Mayer et al. | 208/58 |
| 4,383,913 | 5/1983 | Powell et al. | 208/59 |
| 4,419,220 | 12/1983 | LaPierre | 208/120 |
| 4,435,275 | 3/1984 | Derr | 208/89 |
| 4,501,926 | 2/1985 | LaPierre | 208/111 |
| 4,518,485 | 5/1985 | LaPierre | 208/89 |
| 4,541,919 | 9/1985 | LaPierre | 208/111 |
| 4,554,065 | 11/1985 | Albinson | 208/59 |
| 4,565,621 | 1/1986 | Ward | 585/739 |
| 4,568,655 | 4/1986 | Oleck | 208/251 H |
| 4,647,368 | 3/1987 | McGuiness et al. | 208/60 |
| 4,661,238 | 4/1987 | Humbach et al. | 208/58 |

OTHER PUBLICATIONS

*Oil and Gas Journal*, May 19, 1986, pp. 47–51.

*Primary Examiner*—Anthony McFarlane
*Attorney, Agent, or Firm*—Alexander J. McKillop; Michael G. Gilman; Malcolm D. Keen

[57] ABSTRACT

An integrated refining scheme for hydroprocessing high boiling fractions such as gas oil and catalytically cracked cycle oils to produce premium quality distillates, especially jet fuels and naphthas suitable for reforming into high octane gasoline. In addition, unconverted, high boiling fractions suitable for processing by conventional refining techniques into high quality, low pour point lube base stocks are obtained. The integrated hydroprocessing comprises a first stage hydrocracking step employing an aromatic selective hydrocracking catalyst based on a large pore size acidic component such as amorphous alumina or silica alumina or a large pore size zeolite such as zeolite X or zeolite Y. The hydrocracking may be operated either in a naphtha directing mode under conditions of moderate to high severity or under conditions of low to moderate severity to produce a relatively higher proportion of product boiling in the middle distillate range. The unconverted fraction from the hydrocracking step is passed to a second step in which it is hydroprocessed over a zeolite beta catalyst with additional hydrogenation-dehydrogenation functionality. In this stage, the paraffins remaining in the feed are attacked by the zeolite beta to form isoparaffins and conditions may be controlled to favor hydroisomerization over hydrocracking so as to increase the yield of middle distillate product, especially of high isoparaffinic jet fuels and diesel fuel.

7 Claims, 2 Drawing Sheets

INTEGRATED HYDROPROCESSING SCHEME FOR PRODUCTION OF PREMIUM QUALITY DISTILLATES AND LUBRICANTS

FIELD OF THE INVENTION

This invention relates to the refining of petroleum hydrocarbons and more particularly to a two-stage integrated hydroprocessing scheme in which high boiling petroleum feedstocks may be converted to relatively lower boiling products including high quality naphthas and middle distillates including jet fuels, kerosenes and light fuel oils. The process enables distillate products of high quality to be obtained with minimal hydrogen consumption.

BACKGROUND OF THE INVENTION

The principal objectives in petroleum refining are to separate the components of crude oils of varying compositions and qualities into components with specific utility and, in addition, to increase the yield of relatively high value components from the relatively larger proportion of lower value components in the crude itself. The quality of crude oils which will be processed by refineries is expected to deteriorate progressively in the future while the demand for high boiling and residual products such as heavy fuel oil is expected to decrease. In addition, the effect of laws regulating the quality of petroleum fuels will necessitate the production of higher quality napthas and middle distillates. In particular, regulations controlling the permissible lead content in motor gasoline will necessitate the production of high octane naphtha and requirements for low sulfur middle distillates, especially diesel fuel and home heating oil is expected to lead to more stringent specifications for those products also. At the same time, the decreased demand for heavy fuel oil previously mentioned will make it difficult to supply the improved lower boiling products out of the lower boiling fractions of the crude, commonly referred to as the "top of the barrel". This means that the relatively higher boiling fractions must be processed to satisfy the expected demands but at the same time, the cost of processing must be contained within reasonable bounds. For this reason, although hydroprocessing is expected to play a major role in order to convert the relatively higher boiling fractions in the crude to the more valuable products, the processes should be made as efficient as possible in order to minimize hydrogen consumption. As is well known, hydrogen plants are expensive to construct and also to operate. Thus, there is a continuing need to develop improved processing techniques for converting residua, gas oils and other high boiling materials to naphtha, middle distillates such as diesel fuel, jet fuel, home heating oil, light fuel oil and the like.

Hydrocracking is an established refining process in which a great deal of interest has developed in recent years. This interest has been caused by several factors including the demand for gasoline compared to middle distillates and the necessary for dealing with large volumes of dealkylated refractory effluents from catalytic cracking plants at a time when there has been a decrease in the demand for the fuel oil products into which these refractory materials were previously incorporated. The hydrocracking process is, unlike catalytic cracking, able to deal effectively with these otherwise refractory materials. In addition, by-product hydrogen has become available in large amounts from catalytic reforming operations so that a large proportion of the hydrogen required for hydrocracking can be readily supplied. A further factor which has favored the development of hydrocracking is that over the last 20 years, the use of zeolite cracking catalysts has become predominant and the cycle oils which result from cracking operation with zeolite catalysts tend to be highly aromatic and to be excellent feedstocks for hydrocracking processes.

The hydrocracking feedstock is invariably hydrotreated before being passed to the hydrocracker in order to remove sulfur and nitrogen compounds as well as metals and, in addition, to saturate olefins and to effect a partial saturation of aromatics. The sulfur, nitrogen and oxygen compounds may be removed as inorganic sulfur, nitrogen and water prior to hydrocracking although interstage separation may be omitted, as in the Unicracking-JHC process. Although the presence of large quantities of ammonia may result in a suppression of cracking activity in the subsequent hydrocracking step this may be offset by an increase in the severity of the hydrocracking operation.

In the hydrotreater, a number of different hydrogenation reactions take place including olefin and aromatic ring saturation but the severity of the operation is limited so as to minimize cracking. The hydrotreated feed is then passed to the hydrocracker in which various cracking and hydrogenation reactions occur. The cracking reactions provide olefins for hydrogenation while hydrogenation in turn provides heat for cracking since the hydrogenation reactions are exothermic while the cracking reactions are endothermic; the reaction generally proceeds with an excessive heat generated because the amount of heat released by the exothermic hydrogenation reactions is much greater than the amount of heat consumed by the endothermic cracking reactions. This surplus of heat causes the reactor temperature to increase and accelerate the reaction rate but control is provided by the use of hydrogen quench.

Conventional hydrocracking catalysts combine an acidic function and a hydrogenation function. The acidic function in the catalyst is provided by a porous solid carrier such as alumina, silica-alumina or by a composite of a crystalline zeolite such as faujasite, zeolite X, zeolite Y or mordenite with an amorphous carrier such as silica-alumina. The use of a porous solid with a relatively large pore size in excess of 7A is generally required because the bulky, polycyclic aromatic compounds which constitute a major portion of the typical feedstock require pore sizes of this magnitude in order to gain access to the internal pore structure of the catalyst where the bulk of the cracking reactions takes place.

The hydrogenation function in the hydrocracking catalyst is provided by a transition metal or combination of metals. Noble metals of Group VIIIA of the Periodic Table, especially platinum or paladium may be used but generally, base metals of Groups IVA, VIA and VIIIA are preferred because of their lower cost and relatively greater resistance to the effects of poisoning by contaminants (the Periodic Table used in this specification is the table approved by IUPAC as shown, for example, in the chart of the Fisher Scientific Company, catalog No. 5-702-10). The preferred base metals for use as hydrogenation components are chromium, molybdenum, tungsten, cobalt and nickel and combinations of metals such as nickel-molybdenum, cobalt-molybdenum, cobalt-nickel, nickel-tungsten, cobalt-nickel-molybdenum and nickel-tungsten-titanium have been shown to be very effective and useful.

One characteristic of the conventional hydrocracking catalysts is that they tend to be naphtha directing, that is, they tend to favor the production of naphthas, typically boiling below about 165° C. (about 330° F.) rather than middle distillates such as jet fuel and diesel fuel, typically boiling above about 165° C. (about 330° F.), usually in the range 165° to 345° C. (about 330° to 650° F.). However, the yield of middle distillates may be relatively increased by operating under appropriate conditions. For example, U.S. Pat. No. 4,435,275 describes a process for producing low sulfur distillates by operating the hydrotreating-hydrocracking process without interstage separation and at relatively low pressures, typically below about 7,000 kPa (about 1,000 psig). The middle distillate product from this process is an excellent low sulfur fuel oil but it is generally unsatisfactory for use as a jet fuel because of its high aromatic content; this high aromatic content also makes it unsuitable for use as a diesel fuel on its own but it may be used as a blending component for diesel fuels if other base stocks of higher certane number are available. Conversion is maintained at a relatively low level in order to obtain extended catalyst life between successive regenerations under the low hydrogen pressures used. Relatively small quantities of naphtha are produced but the naphtha which is obtained is an excellent reformer feed because of its high cycloparaffin content, itself a consequence of operating under relatively low hydrogen pressure so that complete saturation of aromatics is avoided.

The use of highly siliceous zeolites as the acidic component of the hydrocracking catalyst will also favor the production of distillates at the expense of naptha, as described in U.S. patent applications Ser. No. 744,897, filed June 17, 1985 and its counterpart EU No. 98,040.

In conventional hydrocracking processes for producing middle distillates, especially jet fuels, from aromatic refinery streams such as catalytic cracking cycle oils it has generally been necessary to employ high pressure hydrotreating typically about 2000 psig to saturate the aromatics present in the fed so as to promote cracking and to ensure that a predominantly paraffinic/naphthenic product is obtained. The hydrocracked bottoms fraction is usually recycled to extinction even though it is highly paraffinic (because of the aromatic-selective character of the catalyst) and could form the basis for a paraffinic lube stock of higher value than the distillate produced by cracking it. Thus, the conventional fuels hydrocracker operating with a cycle oil feed not only is demanding in terms of operating requirements (high hydrogen pressure) but also degrades a potentially useful and valuable product.

A significant departure in hydrocracking is described in U.S. patent application Ser. No. 379,421 and its counterpart EU No. 94,827. The catalyst used in the process is zeolite beta, a zeolite found to have a combination of unique and highly useful properties. Zeolite beta, in contrast to conventional hydrocracking catalysts, has the ability to attack paraffins in the feed in preference to the aromatics. The effect of this is to reduce the paraffin content of the unconverted fraction in the effluent from the hydrocracker so that it has a relatively low pour point. By contrast, conventional hydrocracking catalysts such as the large pore size amorphous materials and crystalline aluminosilicates previously mentioned, are aromatic selective and tend to remove the aromatics from the hydrocracking feed in preference to the paraffins. This results in a net concentration of high molecular weight, waxy paraffins in the unconverted fraction so that the higher boiling fractions from the hydrocracker retain a relatively high pour point (because of the high concentration of waxy paraffins) although the viscosity may be reduced (because of the hydrocracking of the aromatics present in the feed). The high pour point in the unconverted fraction has generally meant that the middle distillates from conventional hydrocracking processes are pour point limited rather than end point limited. The specifications for products such as light fuel oil (LFO), jet fuel and diesel fuel generally specify a minimum initial boiling point (IBP) for safety reasons but end point limitations usually arise from the necessity of ensuring adequate product fluidity rather than from any actual need for an end point limitation in itself. In addition, the pour point requirements which are imposed effectively impose an end point limitation of about 345° C. (about 650° F.) with conventional processing techniques because inclusion of higher boiling fractions including significant quantities of paraffins will raise the pour point above the limit set by the specification. When zeolite beta is used as the hydrocracking catalyst, however, the lower pour point of the unconverted fraction enables the end point for the middle distillates to be extended so that the volume of the distillate pool can be increased. Thus, the use of zeolite beta as the acidic component of the hydrocracking catalyst effectively increases the yield of the more valuable components by reason of its paraffin selective catalytic properties.

Another characteristic of zeolite beta is that it affects removal of waxy paraffinic components from the feed by isomerization as well as by conventional cracking reactions. The waxy paraffinic components, comprising straight chain end paraffins and slightly branched chain paraffins, especially the monomethyl paraffins, are isomerized by zeolite beta to form iso-paraffins which form excellent lubricant bases because the iso-paraffins possess the high viscosity index characteristic of paraffins without the high pour point values which are characteristic of the more waxy paraffins. A process employing this property of zeolite beta for dewaxing feeds to produce a low pour point distillates and gas oil is described in U.S. Pat. No. 4,419,220.

In spite of the potential of improvement offered by the use of zeolite beta as a hydroprocessing catalyst, both in dewaxing processes under conditions of limited severity and conversion and in hydrocracking processes where a significant bulk conversion occurs, the need for improving the yield and quality of the gasoline and middle distillate pool perists. The unique characteristics of zeolite beta and the desirable results demonstrated so far indicate that further improvements may be achieved with it, particularly by integrating its use into other refining schemes which enable its unique properties to be best exploited.

In considering the problems encountered with jet fuel production, the limitations imposed by the moderate pressure hydrocracking process become apparent: the middle distillate product which is obtained is relatively aromatic in character because it is not possible to carry out extensive aromatics saturation at the relatively how hydrogen pressures used. Conversely, the bottoms fraction is relatively paraffinic because of the aromatic-selective character of the catalysts used. Because it is relatively paraffinic, as well as being of high boiling point this bottoms fraction commends itself for consideration as a lubestock or, at least, as the starting point in lubricant stock production. However, it is generally of high pour point and freeze point because of the presence of waxy paraffinic components (n-paraffins and slightly branched chain pariffins, especially mono-methyl paraffins) so that dewaxing is necessary. The present processing scheme effectively integrates jet fuel and middle distillate production by moderate pressure hydrocracking with a catalytic lube production process so as to maximize the production of both types of product and to exploit most effectively the characteristics of the moderate pressure hydrocracking process and the catalystic isomerization dewaxing process using dewaxing catalysts based on zeolite beta.

SUMMARY OF THE INVENTION

It has now been found that the properties of zeolite beta may be effectively exploited in an integrated refining scheme for hydroprocessing high boiling petroleum feedstocks to form napthas and middle distillates of high quality while simultaneously minimizing hydrogen consumption. According to the present invention, the high boiling feedstocks are first subjected to hydrocracking over a relatively large pore size hydrocracking catalyst to form a naptha product and a relatively higher boiling product of enhanced paraffinic content. This relatively higher boiling product is then subjected to hydrocracking and isomerization over zeolite beta to produce a distillate product with a relatively high content of isoparaffins. This distillate product is useful as jet fuel, kerosene, diesel fuel, light fuel oil and is characterized by a low pour point and a low sulfur content. The unconverted fraction remaining after the second hydrocracking step is not only low in sulfur but as a very low pour point. Removal of the aromatics from this fraction results in a lube product of excellent viscosity index (VI).

The integrated refining scheme may be operated so as to produce a number of different products. When the use of the initial hydrocracking steps uses a conventional, naphtha-directing, aromatic-selective hydrocracking catalyst under conditions which produce a naphtha fraction which is relatively high in aromatics and napthenes and which therefore provides an excellent feedstock for the reformer. If the initial hydrocracking step is operated under low severity conditions comparable to those described in U.S. Pat. No. 4,435,275, the middle distillate fraction which is typically aromatic in character is also obtained and this fraction is able to meet product specifications on blending. The objective of the initial aromatic-selective hydrocracking step is, however, to provide a relatively paraffinic feed for the second step using zeolite beta. By using a highly paraffinic feed for the zeolite beta catalyst, the unique properties of this zeolite are exploited to the full because the composition of the feed is more closely matched to the selectivity of this catalyst. Thus, the catalyst is used in an effective manner which not only minimizes hydrogen consumption but also extends catalyst life so as to obtain extended cycle times between successive regenerations. The two steps of the process therefore complement one another, with the aromatic-selective hydrocracking being used in the first step to prepare a relatively, paraffinic product which is processed in the second step by the paraffin-selective zeolite beta. By adjusting the conditions the individual processing steps may be optimized so as to handle the feed most effectively with a view to produce the desired product or products.

DRAWINGS

In the accompanying drawings:

FIG. 1 is a schematic representation of the naphtha-selective hydrocracking-hydroprocessing scheme used to make a high quality reformer naphtha and a low pour point distillate, FIG. 2 is a schematic representation of the distillate-selective, low pressure hydrocracking hydroprocessing scheme used to make an aromatic distillate and a low pour point distillate.

DETAILED DESCRIPTION

Feedstock

Figure 1:
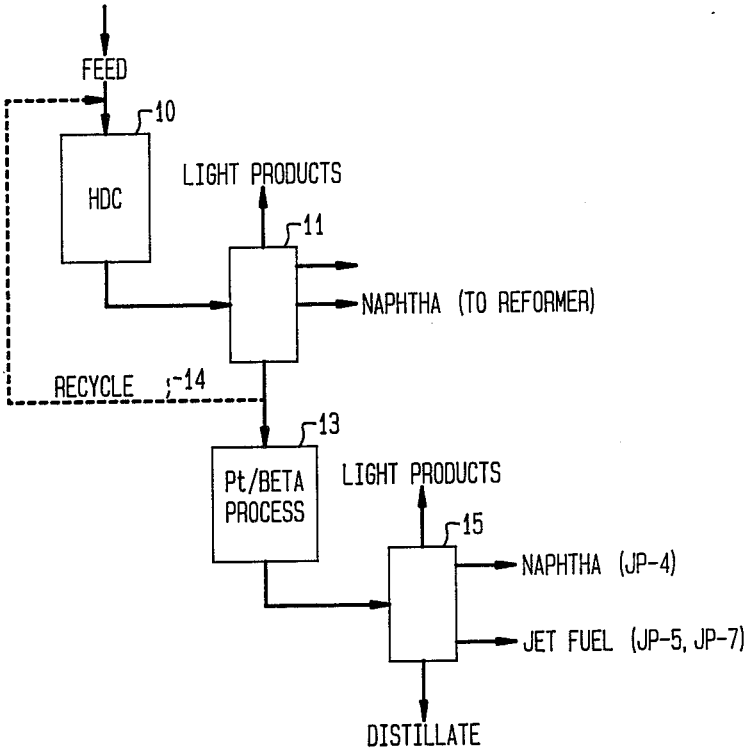

The feedstocks which are employed in the present process may be generally characterized as high boiling point feeds of petroleum origin although feeds of other origin may also be employed, for example, feeds from synthetic oil production processes such as Fischer-Tropsch synthesis or other synthetic processes, e.g. methanol conversion processes. Fractions from unconventional sources such as shale oil and tar sands may also be processed by the present integrated hydroprocessing technique. In general, the feeds will have a relatively high boiling point, usually above about 205° C. (about 400° F.) or higher, for example, above 230° C. (about 450° F.) and in most cases, above about 315° C. (about 600° F.), with many having an initial boiling point of above about 345° C. (about 650° F.). The boiling characteristics, especially the end point, of the feed will be determined by the products required. If lubricants are to be produced in significant quantity, the feed must itself contain significant quantitites of components in the lubricant boiling range, usually above 345° C. (about 650° F.). Thus, when lubricant production is desired, the feed will generally be a gas oil, i.e. a high boiling distillate feed with an end point typically below 565° C. (about 1050° F.) although significant quantities of nondistillable residues are not to be excluded in the feeds which may be processed. Typical feeds which may be processed include gas oils such as coker heavy gas oils, vacuum gas oils, reduced crudes and atmospheric gas oils. By contrast, when the process is to be employed principally for producing middle distillate and naphtha, especially jet fuel, the feed may have a relatively lower end point since there is no need to conserve higher boiling components. Thus, for jet fuel production, catalytic cracking cycle oils including light cycle oil (LCO) and heavy cycle oil (HCO), clarified slurry oil (CSO) and other catalytically cracked products are an especially useful source of feeds from the present process. Cycle oils from catalystic cracking processes typically have a boiling range of about 205° to 400° C. (about 400° to 750° F.) although light cycle oils may have a lower end point e.g. 315° C. or 345° C. (about 600° or 650° F.). Heavy cycle oils may have a higher initial boiling point (IBP) e.g., about 260° C. (about 500° F.). The relatively high aromatic content of the cycle oils renders them extremely suitable for processing in the initial hydrocracking step of the present integrated process sequence and, in addition, the decreasing level of demand for such refractory stocks at the present makes them extremely attractive materials for processing in the present scheme.

Because of their high boiling point, the feeds for use in the present process generally contain relatively high proportions of aromatics, especially of polycyclic aromatics although significant quantities of high boiling paraffins and cycloparaffins are also present. If the feed has been subjected to catalytic cracking, the aromatics will be substantially dealkylated and resistant to further cracking except in a hydrogenative process such as the present one. The present process is notable for its ability to convert refractory aromatic feeds such as those obtained from catalytic cracking operations to high quality, highly paraffinic distillate products of low pour point as well as low pour point lubricants.

As a generalization, the aromatic content of the feeds used in the present process will be at least 30, usually at least 40 weight percent and in many cases at least 50 weight percent. The balance will be divided among paraffins and naphthenes according to the origin of the feed and is previous processing. Catalytically cracked stocks will tend to have higher aromatic contents than other feeds and in some cases, the aromatic content may exceed 60 weight percent. Feeds may be hydrotreated in order to remove contaminants prior to hydrocracking.

Typical vacuum gas oil (VGO) compositions are shown in Tables 1–4, including two hydrotreated (HDT) gas oils in Tables 2 and 3, together with two typical FCC LCO feeds in Tables 5 and 6.

TABLE 1

| VGO Properties | |
|---|---|
| API Gravity | 23.2 |
| Distillation, wt. pct. | |
| 225°–345° C. (440°–650° F.) | 7.0 |
| 345°–400° C. (650°–750° F.) | 17.0 |
| 400° C.+ (750° F.+) | 76.0 |
| Sulfur, wt. pct. | 2.28 |
| Nitrogen, ppmw. | 550 |
| Pour Point, °C. (°F.) | 18 (95) |
| KV at 100° C., cSt. | 5.6 |
| P/N/A, wt. pct. | 29/21/50 |

TABLE 2

| HDT Statfjord VGO | |
|---|---|
| Nominal boiling range, °C. (°F.) | 345–455 (650–850) |
| API Gravity | 31.0 |
| H, wt. pct. | 13.76 |
| S, wt. pct. | 0.012 |
| N, ppmw | 34 |
| Pour Point, °C. (°F.) | 32 (90) |
| KV at 100° C., cSt | 4.139 |
| P/N/A wt % | 30/42/28 |

TABLE 3

| HDT Minas VGO | |
|---|---|
| Nominal boiling range, | 345–510 (650–950) |
| API Gravity | 38.2 |
| H, wt. pct. | 14.65 |
| S, wt. pct. | 0.02 |
| N, ppmw | 16 |
| Pour Point, °C. (°F.) | 38 (100) |
| KV at 100° C., cSt | 3.324 |
| P/N/A wt % | 66/20/14 |

TABLE 4

| Arab Light HVGO | |
|---|---|
| API Gravity | 22.2 |
| Hydrogen, wt. pct. | 12.07 |
| Sulfur, wt. pct. | 2.45 |
| Nitrogen, ppmw | 600 |
| CCR, wt. pct. | 0.4 |

TABLE 4-continued

| Arab Light HVGO | |
|---|---|
| P/N/A, wt. pct. | 24/25.3/50.7 |
| Pour Point, °C. (°F.) | 40 (105) |
| KV at 100° C., cSt | 7.0 |
| Distillation (D-1160), pct. | |
| IBP | 345 (649) |
| 5 | 358 (676) |
| 10 | 367 (693) |
| 50 | 436 (817) |
| 90 | 532 (989) |
| 95 | 552 (1026) |
| FBP | 579 (1075) |

TABLE 5

| FCC LCO Properties | |
|---|---|
| API Gravity | 21.0 |
| TBP, 95%, °C. (°F.) | 362 (683) |
| Hydrogen, wt. pct. | 10.48 |
| Sulfur, wt. pct. | 1.3 |
| Nitrogen, ppmw | 320 |
| Pour Point °C. (°F.) | −15 (5) |
| KV at 100° C. (°F.) | — |
| P/N/A, wt. pct. | — |

TABLE 6

| FCC LCO Properties | |
|---|---|
| Distillation, wt. pct. | |
| 215° C.−(420° F.−) | 4.8 |
| 215–345° C. (420°–650° F.) | 87.9 |
| 345–425° C. (650°–800° F.) | 7.3 |
| 425–540° C. (800°–1000° F.) | — |
| 540° C.+ (1000° F.+) | — |
| H, wt. pct. | 10.64 |
| S, wt. pct. | 1.01 |
| N, wt. pct. | 0.24 |
| Ni + V, ppmw | — |
| CCR, wt. pct. | — |
| HC Type, wt. pct.: | |
| Paraffins wt. pct. | 12.7 |
| Mononaphthenes | 11.7 |
| Polynaphthenes | 12.8 |
| Monoaromatics | 24.7 |
| Diaromatics | 21.7 |
| Polyaromatics | 14.3 |
| Aromatic sulfur type | 2.1 |
| P/N/A | 12.7/24.5/62.8 |

First Stage Hydrocracking

The objective of the hydrocracking which is carried out in the first stage of the operation is to provide a feed with a relatively high concentration of paraffins for processing in the second stage over the zeolite beta based catalyst. Accordingly, the catalyst which is used in the first stage hydrocracking is a catalyst which is selective for the aromatics in the feedstock, that is, that it attacks the aromatics in preference to the paraffins although hydrocracking of the paraffins is not precluded. Conventional hydrocracking catalysts are therefore employed in this stage, using a large pore size solid with acidic functionality coupled with a hydrogenation function. As explained above, the use of the large pore size material is considered essential for hydroprocessing of high boiling feeds such as gas oils in order that the bulky, polycyclic aromatic components in the feed may obtain access to the internal pore structure of the catalyst where the characteristic cracking reactions principally occur. Of course, a limited degree of cracking will occur on the external surfaces of the catalyst particle but since the major part of the surface area of the catalyst is within the particles, it is essential for the components of the feed which are to undergo cracking to have access to this internal pore structure. Accordingly, the acidic functionality in the first stage hydrocracking catalyst is provided either by a large pore, amorphous material such alumina, silica-alumina or silica or by a large pore size crystalline material, preferably a large pore size aluminosilicate zeolite such as zeolite X, zeolite Y, ZSM-3, ZSM-18 or ZSM-20. The zeolites may be used in various cationic and other forms, preferably forms of higher stability so as to resist degradation and consequent loss of acidic functionality under the influence of the hydrothermal conditions encountered during the hydrocracking. Thus, forms, of enhanced stability such as the rare earth exchange large pore zeolites, e.g. REX and REY are preferred, as well as the so-called ultra stable zeolite Y (USY) and high silica zeolites such as dealuminized Y or dealuminized mordenite.

Zeolite ZSM-3 is disclosed in U.S. Pat. No. 3,415,736, zeolite ZSM-18 in U.S. Pat. No. 3,950,496 and zeolite ZSM-20 in U.S. Pat. No. 3,972,983, to which reference is made for a description of these zeolites, their properties and preparations.

Crystalline components may be incorporated into an amorphous matrix for greater physical strength and the matrix itself may be catalytically active, for example, it may be an amorphous alumina or silica-alumina or a clay with acidic functionality so that it participates in the acid-catalyzed cracking reactions which take place. Typically, the matrix will constitute about 40–80 weight percent of the catalyst with about 50–75 weight percent being common.

The hydrogenation function may be provided in the conventional way by use of a base or noble transition metal component, typically from Groups VIA and VIIIA of the Periodic Table, especially nickel, cobalt, tungsten, molybdenum, palladium or platinum with the base metals nickel, tungsten, cobalt and molybdenum being preferred. Combinations such as nickel-tungsten, nickel-cobalt and cobalt-molybdenum being especially useful, particularly with feeds with a relatively high level of contaminants.

By operating with an aromatic-selective, naphtha directing catalyst under conditions of low to moderate severity, a major proportion of naphtha product boiling below about 165° C. (330° F.) may be produced, containing a relatively high quantity of naphthenes which render it valuable for reforming to make high octane gasoline. In addition, a small to moderate quantity of middle distillate is produced together with a high boiling fraction. The naphtha directing, aromatic selectivity of the first stage hydrocracking catalyst effectively concentrates paraffins in the unconverted (to naphtha) fraction and the unconverted fraction is converted in the second stage of treatment to high quality, low pour point distillates by treatment with the zeolite beta catalyst. If the feed contains significant quantities of middle distillate fractions, e.g. as with FCC LCOs which contain substantial amounts of components in the 225°–345° C. (440°–650° F.) range, the feed to the second stage will include the unconverted fraction of the feed. On the other hand, if the feed is a high boiling feed such as a VGO, boiling essentially above 345° C. (650° F.), the feed to the second stage, which comprises the hydrocracked effluent boiling above the naphtha boiling range, will comprise a converted (middle distillate) fraction and an unconverted fraction. The aromatics in the relatively lower boiling feeds in the middle distillate range, e.g. LCO, which would have a detrimental effect on the properties of middle distillates such as jet fuel and diesel fuel are selectively removed during the first stage hydrocracking by the aromatic selective hydrocracking catalyst so that they appear in the low boiling naphtha as low molecular weight aromatics and naphthenes (depending on the extent of the hydrogenation during the hydrocracking) to form a product which is highly suitable for reforming to high octane gasoline. The paraffins in the feed are less subject to conversion during this part of the process and so they remain in the higher boiling (above naphtha) fractions which are then selectively processed in the second step over the paraffin-selective zeolite beta to form the desired highly iso-paraffinic product.

If the stage hydrocracking is operated in a distillate selective mode under conditions of low to moderate severity with low to moderate hydrogen pressures, for example, as described in U.S. Pat. No. 4,435,275, the converted fraction will comprise a major proportion of middle distillates, typically boiling in the 165° to 345° C. (about 330° to 650° F.) with lesser proportions of naphtha. The middle distillate fraction is quite aromatic in character and is generally unsuitable for use directly as jet fuel or diesel but may be used as a blending component for diesel fuels if combined with other, more highly paraffinic components. It may also be used for fuel oils either as such or blended in with other, higher boiling components. This middle distillate fraction is, however, relatively low in sulfur and generally meets product specifications for use as a light fuel oil, e.g. home heating oil. The unconverted fraction from the low-to-moderate pressure first stage hydrocracking is typically waxy and very low in sulfur and nitrogen. Although this product has value and may be sold as low sulfur heavy fuel oil, treatment of it in the second stage with zeolite beta results in a significant increase in distillate yield in quality since the paraffins which remain in the unconverted, hydrocracked fraction, are selectively converted in the second stage to lower boiling products with a high content of isoparaffins. Because the bottoms fraction from the first stage hydrocracking has a low heteroatom content, the process conditions required in the second stage are quite mild and may be easily accomplished at relatively low pressures, typically below about 15,000 kPa (about 2160 psig) and in most cases, below about 10,000 kPa (about 1,435 psig) or 7,000 kPa (about 1,000 psig). This enables the second stage to be carried out within the constraints of existing low pressure units, for example, catalytic hydrodesulfurization (CHD) units which typically operate at pressure below 15,000 kPa (about 2000 psig).

The objective of the first (hydrocracking) step is to convert high boiling aromatic components in the initial feedstock selectively to naphtha or middle distillate. This is followed by the second step where the objective is to convert the unconverted high boiling paraffins to isoparaffins in the middle distillate and lube boiling ranges or to maximize paraffin isomerisation for lubricant products. Use of the conventional hydrocracking catalyst in the first stage enables the aromatics to be selectively removed and converted to lower boiling products either in the naphtha or middle distillate fractions, depending upon the conditions employed in the hydrocracking so that the unconverted residue is highly paraffinic to provide a feed upon which the zeolite beta based catalyst may act with a high degree of efficiency in the second stage. By isomerizing the high boiling fraction from the first stage either in a hydroisomerization step or a combined hydrocracking/hydroisomerization step in the second stage, the quantity of premium quality middle distillate is greatly increased and in particular, the distillate produced is highly paraffinic with a low pour point, making it very suitable for sale as jet fuel and diesel fuel. The quality of the distillate produced is such a nature that it may be sold as JP-4 jet fuel or even as the high energy, highest quality jet fuel, JP-7. This is a particularly desirable aspect of the present invention since JP-7 is normally made from naphtha and kerosene fractions from high pressure hydrocracking using high temperature conditions under high hydrogen pressure over a noble metal catalyst similar to a reforming catalyst in order to saturate aromatics to naphthenes. The present process, however, enables JP-7 quality fuel to be produced under conditions of relatively low pressure using base metal catalysts.

When the hydrocracking step is operated in the naphtha selective mode, conditions of moderate to high severity will be employed. Thus, a relatively acidic catalyst with a naphtha directing tendency will be used at relatively high temperatures towards the upper end of the hydrocracking range, e.g. 400°–450° C. (about 750°–850° F.). Temperatures of this magnitude may readily be attained by control of the hydrogen quench in the reactor, although severity may also be controlled by appropriate regulation of the space velocity. Thus, lower temperatures, e.g. 250°–400° C. (about 480°–750° F.) may be employed with lower space velocities. In order to promote saturation of the aromatics in the feed, high hydrogen partial pressures will be preferred, typically above about 7,000 kPa (about 1,000 psig) and often above about 10,000 kPa (about 1,435 psig) will be typical and preferred for naphtha mode operation. Space velocity (LHSV) will usually be below about 2 $hr^{-1}$ with values below 1 $hr^{-1}$ at lower temperatures. Hydrogen circulation rate will be selected to maintain catalyst activity at the selected temperature and will typically be at least 350 $n.l.l.^{-1}$ (about 1966 SCF/Bbl) and in most cases from 500 to 1,000 $n.l.l.^{-1}$ (about 2810 to 5620 SCF/Bbl). The naphtha-selective hydrocracking step is very effective at reducing the level of sulfur and nitrogen in the unconverted bottoms fraction so that it is characterized by a low level of sulfur and nitrogen as well as a high level of waxy paraffins. These paraffins are then selectively isomerized and hydrocracked by the second stage operation to produce the high quality distillate and kerosene products.

The changes in product distribution which take place when naphtha-selective hydrocracking is used in the first stage can be stated as follows: the feed, comprising paraffins, naphthenes and aromatics is converted to a full range product with a naphtha of pronounced naphthenic/aromatic character. The aromatics in the feed are reduced by the aromatic selective characteristics of the first stage catalyst. The middle distillate is paraffinic in character. When the paraffinic bottoms fraction is subjected to the second stage hydroprocessing over the zeolite beta based catalyst, the paraffins are preferentially converted to low pour point iso-paraffins in the middle distillate boiling range while minor quantities of naphtha are produced. The unconverted fraction is a low pour product by reason of the isomerization of the paraffins in it to iso-paraffins.

As an alternative, the first stage hydrocracking step may be operated under conditions which favor the production of middle distillate as opposed to naphtha. Generally, these conditions will be of low to moderate severity under relatively low hydrogen pressure, as described in U.S. Pat. No. 4,435,275, to which reference is made for a description of such conditions. The catalyst used in this mode of operation does not require to be highly naphtha selective since the objective is to favor the production of middle distillates. Accordingly, the catalyst used will generally be an amorphous material such as alumina or silica alumina but other distillate selective catalysts may be used, for example, high silica zeolite Y, high silica ZSM-20, high silica mordenite or other distillate selective catalysts of the kind described in EU No. 98,040, to which reference is made for a description of such catalysts. The acidic functionality in the catalyst should nevertheless be selective towards aromatics in order that they will be preferentially removed prior to the second stage treatment. For this reason, zeolite beta should not be employed in the frist stage since it will preferentially remove paraffins.

Operation under conditions of relatively low to moderate hydrogen pressure imposes certain process limitations, particularly with respect to aconversion. The aromatic character of the feed with a high content of coke precursors limits the conversion to levels below about 35 volume percent of excessive catalyst aging is to be avoided. However, a proportionably more aromatic product is obtained at higher conversions as more aromatics are removed ater hydrogenation by cracking so that higher conversions may be desirable although not attainable in commercial operation. On the other hand, higher hydrocracking conversion produces a waxier bottoms product which can be actively handled by the second step (zeolite beta) based catalyst so that if a higher catalyst aging rate is accepted in the hydrocracking, the second stage feed is optimized to a greater degree.

Operation in the naphtha mode is favored by the use of more highly acidic catalysts, higher severity and higher hydrogen pressures, although as in all refining processes the exact conditions to employed will be selected according to the characteristics of the feed. In achieving the desired moderate to high severity conditions appropriate for naphtha production, temperature and space velocity (LHSV) interact so that lower temperatures may be used at lower space velocities. Thus, temperatures as low as about 250° C. (about 480° F.) may be employed although higher temperatures, typically above about 315° C. (about 600° F.) will be more common. The upper temperature limit will normally be about 450° C. (about 850° F.) and temperatures of 400°–450° C. (750°–850° F.) will provide appropriate levels of severity at the higher space velocities which permit greater throughput albeit at the expense of accelerated catalyst aging. Space velocity (LHSV) is usually below 2 $hr^{-1}$ with values below 1 $hr^{-1}$ at the lower temperature below about 315° C. (about 600° F.). Operation in the naphtha mode is also favored by the use of higher hydrogen partial pressures to promote aromatics saturation followed by ring opening and cracking to naphtha. Hydrogen partial pressures of at least 7,000 kPa (about 1,000 psig), preferably at least 10,000 kPa (about 1,435 psig) are therefore preferred. Higher pressures of 15,000 kPa (about 2,160 psig) favor aromatics saturation greatly, although at the expense of increased hydrogen consumption. Hydrogen circulation rate is typically at least 300 $n.l.l.^{-1}$ (at least about 1,685 SCF/Bbl), preferably at least 500 $n.l.l.^{-1}$ (about 2,800 SCF/Bbl) and normally in the range 500–1,000 $n.l.l.^{-1}$ (about 2,800–5,600 SCF/Bbl). Conversion per pass to naphtha and lower boiling products (165° C.−) will depend on feed properties and conditions but will generally be in the range 5–25 wt. percent; total bulk conversion per pass (i.e. conversion to lower boiling products) will generally range from 15–80 wt. percent, in most cases 20–60 wt. percent.

Because the high-conversion single pass operation results in a naphtha which is considerably more naphthenic/aromatic in character than the naphtha obtained by operating at lower conversion with recycle, single pass operation is preferred since the naphthenic-/aromatic naphtha will then be more amenable to reforming. In addition, partial conversion with recycle results in a higher gas ($C_1$–$C_4$) make which represents a loss of valuable hydrogen to the upgrading process as a whole. The bottoms product from the naphtha-selective hydrocracking step is, however, concentrated in paraffins (relative to the feed) because the catalyst used in this step attack the aromatics in preference to the paraffins. Processing of the paraffin rich bottoms fraction in the subsequent hydroisomerization step then results in higher total yields of iso-paraffinic liquid products such as jet fuel and low pour point distillate. In addition, processing of the feed in high-conversion, single pass operation in the hydrocracker increases hydrocracking capacity by elimination of the recycle.

Operation of the hydrocracking in a distillate directing mode generally implies lower severity with the use of a less acidic catalyst. Again, temperature in the range of 250°–450° C. (480°–850° F.) may be used although higher space velocities of up to 2 $hr^{-1}$ may be appropriate to obtain the desired severity. If an aromatic distillate product is acceptable, low hydrogen partial pressures may be employed as in the hydrocracking process described in U.S. Pat. No. 4,435,275, to which reference is made for a description of preferred operating conditions in a distillate directing mode. As described there, hydrogen pressures of 5,250 to 7,000 kPa (about 745 to 1,000 psig) are satisfactory with hydrogen circulation rates of 250 to 1,000 $n.l.l.^{-1}$ (about 1,400 to 5,600 SCF/Bbl), ore usually 300 to 800 $n.l.l.^{-1}$ (about 1,685 to 4,500 SCF/Bbl). The bulk conversion to 345° C.−(650° F.−) products will generally be below 50 percent, typically 30–40 percent.

The changes in composition which occur with operation of the hydrocracking step in the low pressure, distillate selective mode can be stated as follows: The feed, comprising a high boiling fraction of paraffins, naphthenes and aromatics, is converted to a full range hydrocracked effluent with a middle distillate of marked aromatic character and a relatively smaller amount of naphtha. The unconverted fraction is again paraffinic in character because of the aromatic-selective nature of the catalyst used in this stage. On contact with the zeolite beta in the second stage, the paraffins are preferentially attacked to form lower boiling iso-paraffins, mainly by reduction in molecular weight (cracking) but with a minor change in boiling point by isomerication to the lower-boiling isomers just below the cut point. Again, the middle distillate is of low pour point by reason of its iso-paraffinic content.

A hydrotreating step may in any case precede the hydrocracking to remove contaminants, principally sulfur, nitrogen and any metals present. Hydrotreating conditions and catalysts will be conventionally chosen for this purpose. Interstage separation of inorganic sulfur and nitrogen may be carried or, as in the low pressure process described in U.S. Pat. No. 4,435,275, omitted.

Because the unconverted fraction from the hydrocracking step is to be processed in the second step over the zeolite beta based catalyst, recycle of the unconverted fraction is not necessary but it desired some recycle may be made to increase the yield of the first stage converted fraction, be it naphtha, middle distillate or both.

When the distillate selective hydrocracking is used in the first stage, the converted fraction will contain relatively higher proportions of paraffins in the back end, i.e. the relatively higher boiling fractions, e.g. 225° to 345° C. (about 440° to 650° F.) and if the cut point for separating the portion fed to the second stage is adjusted accordingly, the isomerization which takes place in the second stage will shift these paraffins to a lower boiling point range by isomerization and hydrocracking. Thus, it may be desirable to feed the second stage with some of the converted fraction from the first stage as well as the essentially unconverted fraction. Cut point may be as low as about 200° C. (about 390° F.) but will generally be at least 225° C. (about 440° F.) and in most cases will be at least 315° C. (about 600° F.), generally at about 345° C. (about 650° F.).

Second Stage

The second stage treatment is essentially a hydrocracking or hydroisomerization step using a catalyst combining acidic functionality based on zeolite beta and hydrogenation functionality. The hydrogenation functionality may be provided either by a base metal or a noble metal as described above, for example, by nickel, tungsten, cobalt, molybdenum, paladium, platinum or combinations of such metals, for example, nickel-tungsten, nickel-cobalt or cobalt-molybdenum. The acidic functionality is provided by zeolite beta which is a known zeolite and is described in U.S. Pat. No. RE 28,341, to which reference is made for a description of this zeolite, its preparation and properties. Hydroprocessing catalysts based on zeolite beta are described in U.S. Pat. Nos. 4,419,220, 4,501,926 and 4,518,485, and U.S. Ser. No. 379,421 and its European counterpart EU No. 94827, to which reference is made for a description of zeolite beta hydroprocessing catalysts which may be used in the second stage of the present integrated process. As described in those patents, the preferred forms of zeolite beta for use in hydroprocessing including the second stage of the present process, are the high silica forms, having a silica:alumina ratio of at least 30:1 (structural). Silica:alumina ratios of at least 50:1 and preferably at least 100:1 or over 100:1 or even higher, e.g. 250:1, 500:1 may be used in order to maximize the paraffin isomerization reactions at the expense of cracking. Thus, use of appropriate silica:alumina ratios in the catalyst may, together with controls of catalyst acidity, as measured typically by alpha value, and control of reaction conditions may therefore be employed to vary the nature of the product, particularly the conversion and accordingly the quantity of the converted fraction from the second stage of the process.

Methods for making highly siliceous forms of zeolite beta are described in EU No. 95,304 to which reference is made for a description of them. The silica:alumina ratios referred to in this specification are the structural or framework ratios as mentioned in EU No. 95,304.

The conditions employed in the second stage will depend upon the nature of the feed from the first stage and the products desired from the second stage treatment. If it is desired to maximize hydroisomerization in the second stage at the expense of hydrocracking, temperatures should be maintained at a relatively low level so as to minimize conversion, i.e. bulk conversion to lower boiling products. To achieve this, relatively low temperatures are required, typically in the range of 200° C. (about 390° F.) to 400° C. (about 750° F.) whereas if it is desired to achieve a significant bulk conversion as well as a hydroisomerization, relatively higher temperatures, typically at least 300° C. (about 570° F.) up to about 450° C. (about 850° F.) will be preferred. The balance of conversion is against isomerization will also be determined by the general severity of the reaction conditions including space velocity which is typically in the range of 0.5 to 10 and more commonly 0.5 to 2, typically about 1 hr.$^{-1}$ (LHSV). Total system pressure in the second stage may vary up to a maximum determined principally by equipment constraints and will generally, for this reason, not exceed 30,000 kPa (about 4350 psig) and in most cases will not exceed about 15,000 kPa (about 2,160 psig). The isomerisation function of the zeolite beta based catalyst decreases at higher hydrogen pressures as the unsaturated intermediates in the reaction mechanism become more subject to interception by saturation reactions. It is therefore desirable to operate the isomerisation at relatively low hydrogen pressures. In many cases, satisfactory results may be obtained below about 10,000 kPa (about 1,435 psig) or even below 7,000 kPa (about 1,000 psig). Hydrogen circulation rates of 200 to 1,000 n.l.l.$^{-1}$ (about 1,125 to 5,600 scf/bbl), preferably 500 to 1,000 n.l.l.$^{-1}$ (about 2,800 to 5,600 scf/bbl) are appropriate. However, the conditions chosen should be selected in accordance with other reaction parameters including the acidity of the catalyst, as described above.

Jet Fuel Production

The present integrated hydroprocessing technique is particularly useful for the production of premium jet fuels such as JP-4 and JP-7 from high boiling fractions with relatively high aromatic contents, such as gas oils, catalytic cracking cycle oils, e.g. LCO and HCO and other high boiling, relatively aromatic starting materials. For reference, the properties of three jet fuels, JP-4, JP-5 (Jet A) and JP-7 are shown below in Table 7.

TABLE 7

| | JP-4 | JP-5 Jet A | JP-7 |
|---|---|---|---|
| API Gravity | 45.0–57.0 | 36–48 | 44–50 |
| Density @ 60° F. | 0.751–0.802 | | 0.7796–0.8063 |
| Hydrogen | min. 13.6 | | |
| Sulfur % | max. 0.40 | 0.40 | 0.10 |
| Mercaptans ppm | max. 10 | 10 | max. 10 |
| Olefins | 5 | 5 | |
| Aromatics % vol. | max. 25.0 | max. 25.0 | max. 5 |
| Flash Point °F. | | min. 140 | min. 140 |
| Freeze Point, °F. | max. −72 | max. −51 | max. −46 |
| Vapor Pressure psi @ 149° C. | | | max. 3 |
| Vapor Pressure psi @ 260° C. | | | max. 48 |
| KV cs @ −20° C. | | max. 8.5 | max. 8.0 |
| Heating Value | | | |
| Gross Btu/lb | | | |
| Net Btu/lb | min. 18,400 | | min. 18,700 |
| Luminometer Number | | | 75 |
| Smoke Point, mm | min. 20 | | 33 |
| Distillation | | | |
| IBP % vol. °F. | | | min. 360 |
| 10 | | 401 | max. 385 |
| 20 | max. 293 | | max. 403 |
| 50 | max. 374 | | |
| 90 | max. 473 | | max. 500 |
| FBP (95 SD) | max. 518 | 554 | max. 550 |
| Residue | max. 1.5 | | max. 1.5 |
| Copper Strip Corrosion @ 212° F. 2 hr | max. lb | lb | lb |
| Existant Gum mg/100 ml | max. 7.0 | 7.0 | 5.0 |
| Naphthalenes % | | | |

When the principal desired product is jet fuel the feed is suitably a catalystic cracking cycle oil, i.e., a highly aromatic, substantially dealkylated feed of low hydrogen content. Light cycle oils e.g. of 400°–700° F. boiling range may be suitably employed since there is no need to retain significant quantities of high boiling fractions, as there is with lubricants. The first stage hydrocracking is operated under conditions of moderate to relatively high severity using an aromatic-selective hydrocracking catalyst to concentrate the paraffins in the unconverted (to naphtha) fraction. The effluent from the hydrocracker is then fractionated to remove the naphtha which has a relatively high aromatic and naphthene content, making it highly suitable for use as a reformer feed. The fraction which is not converted to naphtha and lower boiling fractions is then passed to the second stage which is operated to favor hydroisomerization, that is, to favor isomerization at the expense of bulk conversion, i.e. hydrocracking. Low hydrogen pressures are accordingly favored in this stage. Following the second stage hydroisomerization, the effluent is fractionated to recover the jet fuel as a lower boiling product with higher boiling distillate and naphtha also being obtained. Unconverted (to naphtha) bottoms from the first stage may be recycled to the first stage hydrocracker in order to increase the proportion of naphtha product but generally, it is preferred to operate in single pass mode with all or substantially all of the unconverted fraction from the first stage being processed over the second stage catalyst to produce the premium jet fuel products desired.

Because hydroisomerization in the second stage is the preferred reaction, the second stage catalyst is generally selected to be one which favors the isomerization reaction at the expense of hydrocracking reactions and accordingly, has relatively low acidity coupled with relatively high hydrogeneration-dehydrogenation functionality. For this reason, the zeolite beta preferably has a high silica:alumina ratio above 30:1 and preferably higher, together with a noble metal hydrogenation-dehydrogenation component, preferably platinum. The effluent from the second stage is then fractionated to produce a naphtha which may be blended to produce JP-4 together with significant quantities of premium quality middle distillate useful as JP-5 (Jet A) and JP-7.

FIG. 1 shows a schematic of the process for producing jet fuel in this way. The feed to hydrocracker 10 is typically an LCO but other feeds e.g. hydrotreated gas oil, are possible as described above. The effluent from hydrocracker 10 is passed to fractionator 11 in which the dry gas, lighter products and naphtha are separated from the fraction which has not been converted to naphtha. The bottoms from fractionator 11 is then passed to the second stage unit 13 with recycle to hydrocracker 10 optionally being made through recycle line 14. In the second stage unit, a portion or all of the bottoms fraction from the hydrocracker is processed over the zeolite beta isomerization catalyst to produce a premium quality jet fuel blend which is separated in fractionator 15 to form naphtha which may be used in JP-4 and higher boiling distillates useful as JP-5 (Jet A) and JP-7. As with the distillate/lube production scheme described below, hydrogen consumption during the process is minimized.

In the production of jet fuel from cycle oils, a greater degree of aromatics saturation takes place during the process than with higher boiling feeds such as gas oils because the feed is lower in boiling range and does not contain such high proportions of polycyclic aromatics as the gas oil feeds. In addition, the lower heteroation (N.S.) content resulting from the lower heterocyclic content results in more eeffective hydrogen utilization.

Distillate/Lube Production

Integration of the low to moderate severity hydrocracking step using low hydrogen pressures with the paraffin selective isomerization/ hydrocracking step in the second stage can be used to increase distillate yield and quality and to form low pour point, high boiling fractions suitable for converting to premium lube base stock as described below.

Figure 2:
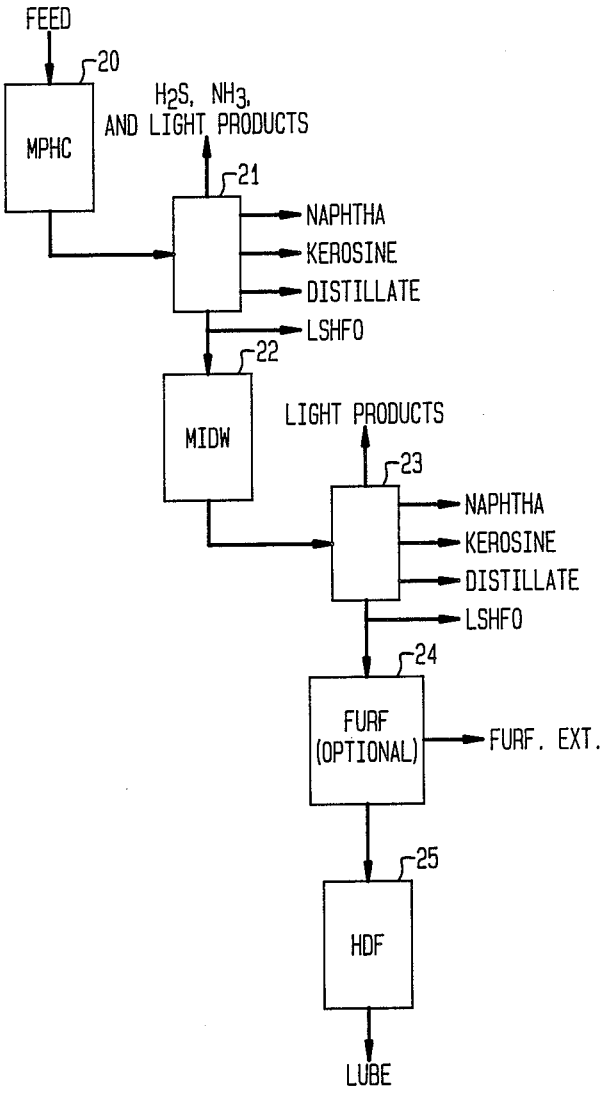

A suitable process scheme is shown in FIG. 2 in which the feed, typically a gas oil feed with an IBP of at least about 315° C. (about 600° F.) is passed to the moderate pressure hydrocracker 20 and processed in a single pass, low to moderate severity hydrocracking operation under low to moderate hydrogen pressures as described above, usually below 10,000 kPa and in most cases below 7,000 kPa in a single pass operation, i.e. without recycle, with conversion limited to about 50 percent maximum, usually 30–50 percent, e.g. 30–40 percent. Preferably, this step is carried out without interstage preparation between the preliminary hydrotreating step and the hydrocracking step, as described in U.S. Pat. No. 4,435,275. The effluent from the hydrocracker is passed to fractionator 21 at which point the inorganic sulfur and nitrogen and other gaseous contaminants are removed together with the light ends. The naphtha, kerosene and distillate may then be separated and the bottoms fraction passed to the second stage although it may also be withdrawn to form a high quality, low sulfur heavy fuel oil. The bottoms fraction forms the bulk of the product because of the low severity operation in the hydrocracking step. Although this bottoms fraction is typically waxy, it is very low in sulfur and nitrogen and, by reason of the low heteroatom content, can be processed under relatively mild conditions in the second stage hydroisomerization/hydrocracking step which is carried out in reactor 22. The effluent from reactor 22 is then passed to fractionator 23 for separation of light products together with naphtha, kerosene, distillate fractions and the bottoms. Again, the bottoms fraction may be used as a low sulfur, heavy fuel oil but this time the pour point will be considerably reduced because of the isomerization of the waxy components which has occurred over the zeolite beta catalyst. The naphtha product which is removed from fractionator 23 is highly paraffinic and can be used as a JP-4 jet fuel component. The kerosene fraction is low in aromatics and suitable for use as a jet fuel, diesel fuel or as a premium blending component for distillate. The distillate also has excellent properties and is particularly notable for an excellent, high Diesel Index (Diesel Index is the product of Aniline Point (° F.) and API Gravity/100). A particularly notable feature of the product from the second stage is that the pour point of the extended end point distillate product (380° C., 715° F. E.P.) is actually lower than that of the 345° C.− (650° F.−) distillate fraction from the first stage, indicating the paraffin isomerization activity of the zeolite beta catalyst.

Because the zeolite beta catalyst is so effective at lowering pour points of the relatively high boiling fractions, it is possible to extend the end point of the distillate fraction up to unconventionally high values, typically up to about 380° C. (about 715° F.) or even higher, depending upon the pour point limitation in the relevant product specification. In some cases, the middle distillate end point may be as high as about 400° C. (about 750° F.).

The high boiling bottoms fraction, e.g. the 400° C.+ (750° F.+) bottoms fraction remaining after the second stage is not only low in sulfur but itself also possesses a very low pour point for such a high boiling material. This bottoms fraction may be upgraded to produce a premium grade lube base stock using conventional lube processing technology. Thus, the bottoms fraction from fractionator 23 may be passed to an aromatics extraction step 24, e.g. extraction with furfural, Sulfolane or Chlorex to produce a lube base stock of reduced aromatic content which may then be treated to removed unsaturates and color bodies, for example, in a catalytic hydrofinishing step 25 or by other conventional processing such as clay percolation.

EXAMPLE 1

An Arab Light Quatar 345°–540° C. (650°–1000° F.) VGO was subjected to moderate pressure hydrocracking using a commercial HDT/HC catalyst. The feed was hydrocracked over a large pore hydrocracking catalyst (Ni-W/REX/$SiO_2$—$Al_2O_3$) at 400° C. (750° F.), 5480 kPa (780 psig) hydrogen partial pressure, 0.5 LHSV and 625 n.l.l$^{-1}$ (3500 SCF/Bbl) $H_2$:oil ratio. This resulted in about 35 percent conversion of the 345° C.+ (650° F.+) feed to distillate and lighter products. The hydrocracking was operated in single pass mode and the entire effluent was fractionated to produce a 345° C.+ (650° F.+) bottoms which was used as feed for the second stage.

In the second stage, the 345° C.+ (650° F.+) hydrocracked feed was subjected to hydrocracking/hydroisomerization over a Pt/zeolite beta catalyst (0.6% Pt on zeolite, zeolite:matrix ratio 50:50 steamed to catalyst alpha value of 50) at 370° C. (700° F.), 2860 kPa (400 psig) hydrogen partial pressure, 1.0 LHSV and 445 n.l.l.$^{-1}$ (2500 SCF/Bbl) hydrogen:oil. The catalyst was lined out at these operating conditions and an aging rate of less than 0.1° C. (0.2° F.) per day was established.

The conditions used and the results obtained are shown in Table 8A below, with the mass balance in Table 8B.

TABLE 8A

| | HC-Isom of ALVGO | | | |
|---|---|---|---|---|
| | Feed | HC | HC-Isom | Overall |
| Days on Stream | | 20–90 | 23 | |
| Temperature °F. | | approx. 750 | 702 | |

TABLE 8A-continued

| | HC-Isom of ALVGO | | | |
|---|---|---|---|---|
| | Feed | HC | HC-Isom | Overall |
| Pressure, psig | | 780 | 400 | |
| LHSV | | 0.5 | 1.0 | |
| $H_2$ SCF/B, inlet | | approx. 3500 | approx. 2500 | |
| Conversion 650° F.+ | — | 35.7 | 28.8 | 53.4 |
| $H_2$ Consumption, SCF/B | — | 490 | 260 | 645 |
| (H) (as cut wt. pct.) | — | (0.8) | (0.4) | (1.0) |
| $H_2S + NH_3$ | — | 2.3 | — | 2.3 |
| $C_1$-$C_4$ | — | 2.0 | 2.9 | 3.7 |
| $C_5$-330° F. Naphtha | — | 6.8 | 11.1 | 13.3 |
| 330-440° F. Kerosene | — | 5.9 | 4.8 | 8.8 |
| 440-650° F. Distillate | 7.0 | 24.0 | 9.2 | 29.5 |
| 650-750° F. Distillate | 17.0 | | 20.0 | 12.0 |
| 750° F.+ | 76.0 | 59.8 | 52.3 | 31.3 |
| Kerosene Properties, As Cut | | | | |
| API Gravity | — | 38.4 | 51.3 | |
| Hydrogen % wt. | — | 12.81 | 15.00 | |
| Pour Point, °F. | — | less than −65 | −90 | |
| Smoke Point, mm | — | 12.5 | (31) | |
| Diesel Index | — | 34 | 80 | |
| Aromatics, % wt. | — | 40.9 | — | |
| Distillate Properties, As Cut | | | | |
| API Gravity | — | 29.3 | 31.8 | |
| Pour Point, °F. | — | 0 | −15 | |
| KV cs @ 40° C. | — | 3.52 | 6.92 | |
| Diesel Index | — | 35 | 51 | |
| 5/50/45 %, °F. (D2887) | — | 496/550/608 | (482/654/715) | |
| Bottoms Properties, As Cut | | (MIDW) Feed | | |
| API Gravity | 23.2 | 29.7 (29.6) | 27.8 | |
| Sulfur, % wt. | 2.28 | 0.028 (0.023) | 0.016 | |
| Nitrogen, ppmw | 550 | 32 (35) | 35 | |
| Pour Point, °F. | +95 | +85 (+95) | −10 | |
| KV cs @ 100° C. | 5.6 | 4.32 (4.93) | 7.08 | |
| Viscosity Index | — | — (—) | 93 | |

TABLE 8B

| | HC- HC/Isom Material Balance | | | |
|---|---|---|---|---|
| | Feed | HC | HC/Isom | Overall |
| 345° C.+ Conversion, wt. pct. | — | 35.7 | 28.8 | 53.4 |
| Hydrogen, wt. pct. | — | 0.8 | 0.4 | 1.0 |
| $H_2S + NH_3$ | — | 2.3 | 0.0 | 2.3 |
| $C_1$-$C_4$ | — | 2.0 | 2.9 | 3.7 |
| $C_5$-165° C. ($C_5$-330° F.) Naphtha | — | 6.8 | 11.1 | 13.3 |
| 165°-225° C. (330-440° F.) Kerosene | — | 5.9 | 4.8 | 8.8 |
| 225°-345° C. (440-650° F.) Distillate | 7.0 | 24.0 | 9.2 | 29.5 |
| 345°-400° C. (650-750° F.) Distillate | 17.0 | — | 20.0 | 12.0 |
| 345°/400° C.+(650/750° F.+) Bottoms | 76.0 | 59.8 | 52.3 | 31.3 |
| $H_2$ Consumption, n.l.l.$^{-1}$ (SCF/B) | — | 87(490) | 46(260) | 115(645) |

The results in Table 8 show a significant increase in the effective conversion of the VGO to improved quality kerosene and distillate products. The kerosene quality is notably improved and the hydroisomerized products (including a portion of the naphtha) would be suitable for jet fuel.

The material balance results show that a significant increase in conversion is obtained with processing over zeolite beta, with minimal hydrogen consumption. In addition, analysis of the product fractions indicates that there has been considerable dewaxing of the 345°-400° C. (650°-750° F.) distillate to −26° C. (−15° F.) pour point, making it suitable for inclusion in the distillate pool.

The improvements in kerosene and distillate quality may be attributed to preferential conversion of the paraffins in the second stage feed by isomerization coupled with distllate selective hydrocracking, as shown in Table 9A below which gives the analyses of the product fractions. The yields shown in Table 9A are based on the original feed to the hydrocracker. As noted previously, the kerosene and distillate products obtained by the low pressure, distillate-selective hydrocracking are relatively aromatic, and have marginal distillate properties. The kerosene contains about 41% aromatics, which is reflected by the low smoke point. Distilling deeper into the bottoms fraction improves the distillate Diesel Index somewhat, but has a detrimental effect on the pour point.

TABLE 9A

| | HC-HC/Isom Product Properties | | |
|---|---|---|---|
| | Feed | HC | HC/Isom |
| Kerosene, wt. pct. | — | 5.9 | 2.9 |
| API Gravity | — | 38.4 | 51.3 |
| Diesel Index | — | 34 | 80 |
| Pour Point, °C. (°F.) | — | −54 (−65) | −68 (−90) |
| Smoke Point, mm | — | 12.5 | 31.0 |
| Distillate, wt. pct. | — | 24.0 | 17.5 |
| API Gravity | — | 29.3 | 31.8 |
| Diesel Index | — | 35 | 51 |

TABLE 9A-continued

| | HC-HC/Isom Product Properties | | |
|---|---|---|---|
| | Feed | HC | HC/Isom |
| KV, cs at 40° C. | — | 3.52 | 6.92 |
| Pour Point, °C. (°F.) | — | −18 (0) | −26 (−15) |
| TBP 95%, °C. (°F.) | — | 320 (608) | 380 (715) |
| Bottoms, wt. pct. | 100.0 | 59.8 | 31.3 |
| API Gravity | 23.2 | 29.7 | 27.8 |
| Sulfur, wt. pct. | 2.28 | 0.028 | 0.016 |
| Nitrogen, ppmw | 550 | 32 | 35 |
| Pour Point, °C. (°F.) | 35 (+95) | 29 (+85) | −23 (−10) |
| KV, cs at 100° C. | 5.60 | 4.32 | 7.08 |

By contrast, the products obtained by processing the hydrocracker bottoms fraction over zeolite beta are of very high quality. The naphtha is highly paraffinic and could be used as a JP-4 jet fuel component. The kerosene fraction is low in aromatics and suitable for use as jet fuel or as a premium blending component for the distillate. The distillate obtained by processing over zeolite beta also has excellent properties and has a notably high Diesel Index. Note that the pour point of the extended endpoint distillate product is actually lower than that of the hydrocracked distillate.

The 400° C.+ (750° F.+) bottoms fraction remaining after processing over zeolite beta is not only low in sulfur, but is characterized by a very low pour point. This product was dark in appearance and lacked optical clarity. However, additional analysis indicated that it could be readily upgraded to premium lube base stocks. Table 9B below gives the relevant compositional data for the high boiling fractions at each step of the process.

TABLE 9B

| | HC-Isom of ALVGO | | | |
|---|---|---|---|---|
| | VGO Feed | HC 345° C.+ | HC-Isom 345°-400° C. | HC-Isom 400° C.+ |
| Paraffins | 29 | 34 | 30 | 26 |
| Naphthenes | 21 | 31 | 26 | 32 |
| Aromatics | 50 | 35 | 44 | 42 |
| Pour Pt. °C.(°F.) | 35 (95) | 35 (95) | −26 (−15) | −23 (−10) |
| KV at 40° C., cSt | — | — | 10.70 | 51.55 |
| KV at 100° C., cSt | 5.6 | 4.32 | 2.63 | 7.08 |
| VI | — | — | 65.6 | 93.1 |

The high VI of the dewaxed 400° C.+ product indicates potential for lube application and extraction with furfural (150 vol. percent, 82° C.) gave an 82 wt. percent yield of a clear, amber oil of improved VI. The furfural extract was then hydrofinished using Harshaw HDN-30 catalyst (Ni-Mo/$Al_2O_3$) at 300° C. (575° F.), 10,445 kPa (1500 psig), 1.0 $hr^{-1}$ LHSV and 1,424 n.l.l.$^{-1}$ (8000 SCF/Bbl) hydrogen:oil. The product obtained is colorless (ASTM color=LOP) and had the properties shown in Table 10, below.

TABLE 10

| Product | HC-Isom 750+ | Furf Raff. | HDF |
|---|---|---|---|
| API Gravity | 27.8 | 31.1 | 318 |
| Hydrogen wt. pct. | 13.03 | 13.85 | 13.96 |
| Sulfur, ppmw | 160 | 80 | 39 |
| Nitrogen, ppmw | 35 | 1 | max. 0.2 |
| Paraffins | 26 | 29 | 32 |
| Naphthenes | 32 | 41 | 43 |
| Aromatics | 42 | 30 | 25 |
| Cloud Point, °F. | — | — | +40 |
| Pour Point, °F. | −10 | +15 | +20 |
| KV cs @ 40° C. | 51.6 | 44.3 | 44.48 |
| KV cs @ 100° C. | 7.08 | 6.79 | 6.79 |

TABLE 10-continued

| Product | HC-Isom 750+ | Furf Raff. | HDF |
|---|---|---|---|
| Color, ASTM | dark | L 4.5 | L 0.0 |
| Viscosity Index | 93 | 107 | 107 |
| Viscosity sus @ 100° F. | — | 206 | 210 |

The next yield of the hydrofinished product was 25.8 wt. percent based on the original VGO charged to the hydrocracker. The properties of the hydrofinished product indicate potential for high quality lube applications such as turbine oil.

EXAMPLE 2

Another high quality lube product was produced by passing the 370° C.+ (700° F.+) product from the hydrocracking step to hydroisomerization over the same Pt/beta catalyst as in Example 1. The furfural extraction and hydrofinishing were then carried out as in Example 1. The properties of the intermediate and final products are shown in Table 11 below, with additional data on the hydrofinished lube in Table 12.

TABLE 11

| Product | HC-370° C.+ | HC-Isom 400° C.+ | Furf Raff | HDF |
|---|---|---|---|---|
| API | 313 | 28.6 | 30.3 | 31.2 |
| Hydrogen % wt. | 13.85 | 13.46 | 13.90 | 14.10 |
| Paraffins % wt. | 36 | 28 | 28 | — |
| Naphthenes | 37 | 43 | 50 | — |
| Aromatics | 27 | 29 | 22 | 15 |
| Cloud Point °F. | — | — | +52 | +50 |
| Pour Point °F. | +95 | −23 | +10 | +15 |
| KV cs @ 40° C. | 40.18 | 64.03 | 59.90 | 58.81 |
| KV cs @ 100° C. | 5.335 | 8.102 | 7.974 | 7.891 |
| Color | dark | dark | L 4.0 | L 0.5 |
| VI | — | 92.1 | 98.5 | 98.8 |

TABLE 12

| | HDF Lube Properties | |
|---|---|---|
| | | Target |
| Color stability (oven) | 7.0 | 3 max |
| RBOT | 245 | 300 min |
| UV abs., | | |
| 275 m. × $10^{-6}$ | 4.4 × $10^{-1}$ | — |
| 325 m. × $10^{-6}$ | 2.2 × $10^{-2}$ | — |
| 400 m. × $10^{-6}$ | 5.1 × $10^{-4}$ | 2 × $10^{-5}$ max |

The relatively high UV absorption at 400 microns indicates an excessive aromatic content and the color stability is not wholly satisfactory but with higher pressure operation in the hydrofinisher, improvement might be noted. The high cloud point (10° C., 50° F.) relative to the pour point (−9° C., 15° F.) may be due to a relatively small quantity of n-paraffins remaining in the product following treatment with the zeolite beta.

EXAMPLE 3

The effect of operating the hydrocracking in single pass mode is illustrated by a comparison of hydrocracking a hydrotreated FCC light cycle oil which has been stripped to remove sulfur, nitrogen and other light products (160°-390° C., 320°-730° F., nominal; API 34.1, 17 ppmws, less than 0.2 ppmw N) over a highly acidic hydrocracking catalyst (Ni-W/REX/$SiO_2$—$Al_2O_3$). Data comparing extinction recycle operation (60% conversion per pass to 205° C.− products) with single pass operation are given in Table 13 below.

TABLE 13

| Recycle/Single Pass Hydrocracking | Recycle | Single Pass |
|---|---|---|
| DOS | 7.2 | 8.9 |
| Temp, °C. (°F.) | 303 (578) | 310 (591) |
| Pressure, kPa (psig) | 10790 (1550) | 9410 (1350) |
| LHSV (fresh feed) $hr^{-1}$ | 0.54 | 1.06 |
| $H_2$ at mkt, n.l.l.$^{-1}$ (SCF/Bbl) | 900 (5043) | 1353 (7603) |
| 156° C.+ (385° F.+) Conv. per pass, pct. | 55 vol. | 44.3 wt. |
| $C_1$–$C_3$, wt. pct. | 1.2 | 0.8 |
| iso-$C_4$, wt. pct. | 6.3 | 2.4 |
| n-$C_4$, wt. pct. | 2.0 | 1.0 |
| $C_5$–196° C. naphtha, wt. pct. | 92.5 | 45.2 |
| 196° C.+ | — | 50.6 |
| $H_2$ consump. n.l.l.$^{-1}$ (SCF/Bbl) | 210 (1178) | 133 (750) |
| Intermediate naphtha comp. (120°–165° C., 250°–330° F.) | | |
| P/N/A, wt. pct | 42/52/6 | 19/63/18 |

Although the reaction conditions were not identical in these runs, the comparison of the results given in the table indicates that recycle of the hydrocracker bottoms significantly increases the concentration of paraffins in the naphtha product, making less amenable to high efficiency reforming, i.e. for obtaining a high yield at the same octane number.

Analysis of the 260° C.+ (500° F.+) fraction from single pass operation shows that this fraction is highly paraffinic, as indicated by Table 14 below.

TABLE 14

| Single Pass HC 260° C.+ Analysis | |
|---|---|
| Yield, as cut, wt. pct. | 32.9 |
| P/N/A, wt. pct. | 63/33/4 |
| Pour Point, °C. (°F.) | 15 (60) |

This fraction is a highly suitable feed for the second stage of the process in which the paraffin-selective, isomerizing properties of zeolite beta are exploited to produce a low pour point, distillate product, e.g. jet fuel of premium quality. Further, elimination of hydrocracker recycle results in a potential increase in capacity with a higher yield of high octane naphtha after reforming.

EXAMPLE 4

In this example, the recycle from the hydrocracking operation of Example 3 (recycle mode) is used as the feed to a second stage hydrocracking/hydroisomerization over a zeolite beta based catalyst.

The recycle stream used as the feed had the composition shown in Table 15.

TABLE 15

| HC-Isom Feed | |
|---|---|
| API Gravity | 44.1 |
| Hydrogen, wt. pct. | 14.12 |
| Sulfur, wt. pct. | — |
| Nitrogen, ppmw | 2 |
| P/N/A, wt. pct. | 66/19/15 |
| Pour Point, °C. (°F.) | −18 (0) |
| Smoke Point, mm | 26 |
| TBP 95%, °C. (°F.) | 330 (626) |

This stream was hydroprocessed over a Pt/zeolite beta catalyst (0.6% Pt, 50% beta/50% $Al_2O_3$) at 305° C. (580° F.), 2860 kPa (400 psig), 1.0 LHSV and 445 n.l.l.$^{-1}$ (2500 SCF/Bbl) $H_2$.

Material balance results showed that the light gas make was very low, 0.4 wt. percent $C_1$–$C_3$ (mainly $C_3$) with a high iso-$C_4$/n-$C_4$ ratio (4.2:1), with about 2.5 and 0.6 wt. percent isobutane and n-butane respectively. The naphtha is highly iso-paraffinic and suitable for reforming of JP-4 jet fuel blending.

TABLE 16

| Material Balance | | |
|---|---|---|
| Yields, wt. % | Feed | Product |
| $C_1$–$C_3$ | — | 0.4 |
| iso-$C_4$ | — | 2.5 |
| n-$C_4$ | — | 0.6 |
| $C_5$–165° C. ($C_5$–330° F.) | 6.6 | 31.3 |
| 165°–290° C. (330–550° F.) | 63.5 | 59.2 |
| 290° C.+ (550° F.+) | 29.9 | 7.3 |
| TLP Pour Point, °C.(°F.) | 0 | −84 (−120) |
| $H_2$ Consumption, n.l.l.$^{-1}$ (SCF/B) | — | 117 (660) |

These results also indicate that, in addition to considerable paraffin isomerization, there is some hydrocracking and saturation of aromatics. The very low pour point of the total liquid product (TLP) is an indication of the extensive paraffin isomerization that has occurred. The moderate hydrogen consumption is mostly due to aromatics saturation.

Analyses of the distilled products obtained from the process indicate that entire 120° C.+ (250° F.+) product (as cut) essentially meets JET-A specifications, and that the nominal 165°–290° C. (330°–550° F.) fraction meets many of the JP-7 specifications, as shown in Table 17 below.

TABLE 17

| Jet Fuel Properties | Product Composition | | Specifications | |
|---|---|---|---|---|
| | 120° C.+ (250° F.+) | 165°–290° C. (330°–550° F.) | Jet-A | JP-7 |
| Yield, wt. pct. | 83.0 | 59.2 | — | — |
| Yield, vol. pct. | 84.6 | 60.2 | — | — |
| API Gravity | 47.6 | 47.0 | 37–51 | 44–50 |
| Hydrogen, wt. pct. | 14.61 | 14.88 | — | — |
| Sulfur, ppmw | 0 | 0 | 0.3 max | 0.1 |
| Aromatics, vol. pct. | 7 | 5 | 25.0 max | 5 |
| Flash Point, °C. (°F.) | 55 (131) | 74 (165) | 38 (100) | min 60 (140) |
| Freeze Point °C. (°F.) | −51 (−60) | −49 (−56) | −40 (−40) | max −43 (−46) |
| KV, cs at −20° C. | 5.87 | 6.78 | 8.0 | max 8.0 |
| Smoke Point, mm | 34.0 | 35.0 | 18.0 | min 33 |
| Heat of Comb. kJ/kg. (Btu/lb) | 43768 (18817) | 43917 (18881) | 42800 (18400) | min 43500 min (18700) |
| Distillation (D-86) | | | | |
| IBP, °C. (°F.) | 170 (338) | 200 (392) | — | min 182 (360) |

TABLE 17-continued

| | Jet Fuel Properties | | | |
|---|---|---|---|---|
| | Product Composition | | Specifications | |
| | 120° C.+ (250° F.+) | 165°-290° C. (330°-550° F.) | Jet-A | JP-7 |
| 10% | 184 (363) | 207 (405) | 205 (400) | max 196 (385) |
| 20% | 189 (373) | 210 (410) | — | max 206 (403) |
| 50% | 217 (423) | 223 (434) | — | — |
| 90% | 267 (513) | 253 (487) | — | max 260 (500) |
| FBP | 302 (576) | 260 (500) | 300 (572) | max 290 (550) |

Both products are low in aromatics and have correspondingly high smoke points. The isoparaffinic composition of these products results in the exceptionally high net heats of combustion, which approach the theoretical limit for hydrocarbons in this boiling range.

There has been a considerable reduction in endpoint, about 28° C. (50° F.) relative to the feed, which allows virtually all of the 120° C.+ (250° F.+) product to be used as jet fuel. Other feeds to this process may result in products which would require distillation to meet endpoint specifications.

Analysis of the 290° C.+ (550° F.+) product indicates that it is highly isoparaffinic and would make an excellent blending component for distillate fuels, as shown in Table 18.

TABLE 18

| | 290° C.+ (550° F.+) Composition | | |
|---|---|---|---|
| | Feed | Product | Typical No. 2 Fuel Oil |
| Yield, wt. pct. | 29.9 | 7.3 | — |
| API Gravity | 45.1 | 41.8 | 36 |
| Hydrogen, wt. pct. | 14.90 | 14.81 | — |
| Paraffins, wt. pct. | 86.8 | 73.8 | — |
| Naphthenes | 4.7 | 13.0 | — |
| Aromatics | 8.6 | 13.2 | 25-35 |
| Pour Point, °C. (°F.) | 10 (+50) | −54 (−65) | −18 (0) |
| KV cs at 40° C. | 3.89 | 4.47 | 3-4 |
| Diesel Index | 90 | 83 | 45 |

The isoparaffinic character of this product is reflected by the very low pour point and the complete absence of n-paraffins by GC analysis. Distillates of this composition would have exceptional ignition characteristics in diesel engine applications.

This process enables premium jet fuels from virtually any gas oil feed, including even highly aromatic materials such as FCC LCO. Product qualities approaching those of JP-7 Jet Fuel, with a present value of about 60 $/bbl, were achieved with moderate hydrogen consumption. In addition, divertion of the paraffinic hydrocracker bottoms product to the zeolite beta processing step effectively increases the capacity of the hydrocracker (in the absence of other restrictions, such as the desulfurization capacity of the hydrotreater). The naphtha produced in the hydrocracking stage would be less paraffinic and therefore results in higher yields on reforming. The hydrocracker bottoms is, moreover, low in heteroatoms and may be processed under low pressures and moderate temperatures.

We claim:

1. An integrated hydroprocessing method for upgrading a gas oil hydrocarbon feedstock having an initial boiling point of at least 315° C. into a naphtha product, a distillate product boiling above the naphtha and a lubricant product with reduced hydrogen consumption, which method comprises (i) hydrocracking the hydrocarbon feedstock over an aromatic-selective hydrocracking catalyst having acidic functionality and hydrogenation-dehydrogenation functionality, under hydrocracking conditions at a hydrogen partial pressure of less than 10,000 kPa and at less than 50 volume percent conversion to lower boiling products, to form a naphtha product a distillate product, and a bottoms fraction enriched in paraffinic components, (ii) separating the naphtha product, the distillate product, and the bottoms fraction, (iii) hydroprocessing the separated bottoms fraction over a hydroprocessing catalyst comprising zeolite beta as an acidic component and a hydrogenation-dehydrogenation component, to produce an isoparaffinic product, and (iv) separating the isoparaffinic product from (iii) into a lubricant fraction and a fraction boiling below the lubricant boiling range.

2. A method according to claim 1 in which the hydrocracking catalyst used in the first step comprises an amorphous hydrocracking catalyst of alumina or silica-alumina.

3. A method according to claim 1 in which the hydrocracking catalyst of the first step comprises an aromatic-selective large pore size zeolite.

4. A method according to claim 1 in which the hydrocracking step is operated under a hydrogen partial pressure of less than 7,000 kPa.

5. A method according to claim 1 in which the hydrocracking step is operated in single pass mode at a conversion of less than 50 volume percent.

6. A method according to claim 5 in which the lubricant fraction separated from the fraction boiling below the lubricant boiling range is subjected to an aromatics extraction step to remove aromatic components and produce a lubricant raffinate.

7. A method according to claim 6 in which the lubricant raffinate is subjected to hydrofinishing.

* * * * *